US006030757A

United States Patent [19]

Heremans et al.

[11] Patent Number: 6,030,757

[45] Date of Patent: Feb. 29, 2000

[54] MULTILAYER SILVER HALIDE PHOTOGRAPHIC MATERIAL AND IMAGE-FORMING METHOD IN INDUSTRIAL RADIOGRAPHIC NON-DESTRUCTIVE TESTING APPLICATIONS

[75] Inventors: Luc Heremans, Leuven; Ann Verbeeck, Begijnendijk, both of Belgium

[73] Assignee: AGFA-Gevaert, N.V., Mortsel, Belgium

[21] Appl. No.: 09/109,199

[22] Filed: Jul. 2, 1998

[30] Foreign Application Priority Data

Jul. 10, 1997 [EP] European Pat. Off. ..... 97202116

[51] Int. Cl.[7] ..... G03C 5/16; G03C 5/17; G03C 1/005; G03C 1/035; G03C 5/305

[52] U.S. Cl. ..... 430/488; 430/567; 430/523; 430/611; 430/966; 430/967

[58] Field of Search ..... 430/567, 966, 430/967, 488, 611, 523

[56] References Cited

U.S. PATENT DOCUMENTS

| | | | |
|---|---|---|---|
| 4,141,734 | 2/1979 | Lenoir et al. | 430/141 |
| 4,798,775 | 1/1989 | Yagi et al. | 430/567 |
| 5,639,591 | 6/1997 | Adachi | 430/567 |

*Primary Examiner*—Mark F. Huff
*Attorney, Agent, or Firm*—Breiner & Breiner

[57] ABSTRACT

A black-and-white silver halide photographic material is disclosed, said material comprising a support and on both sides thereof two light-sensitive emulsion layers and a protective antistress layer as an outermost layer, wherein per side of the support a total amount of silver, expressed as equivalent amount of silver nitrate of at least 5 g is coated, wherein the light-sensitive emulsion layer more close to the said outermost layer is provided with at least one spectrally sensitized silver halide emulsion having tabular emulsion crystals with {111} or {100} major faces, and wherein the emulsion layer more close to the said support is provided with at least one non-spectrally sensitized emulsion having essentially cubic silver halide emulsion crystals, characterized in that the said cubic emulsion crystals or the said tabular emulsion crystals or both have a halide composition including bromide.

11 Claims, No Drawings

MULTILAYER SILVER HALIDE PHOTOGRAPHIC MATERIAL AND IMAGE-FORMING METHOD IN INDUSTRIAL RADIOGRAPHIC NON-DESTRUCTIVE TESTING APPLICATIONS

FIELD OF THE INVENTION

The present invention relates to a light-sensitive black-and-white silver halide photographic material having a multilayer composition of light-sensitive silver halide emulsion layers comprising negative image type tabular emulsion crystals and a method of image formation in the field of industrial radiographic non-destructive testing applications.

BACKGROUND OF THE INVENTION

Light-sensitive black-and-white as well as color photographic silver halide materials comprising silver halide emulsion layers having negative image type tabular silver halide emulsion crystals or grains have become more and more important during the last decade. Tabular silver halide grains are meanwhile well-known as crystals possessing two parallel faces with a ratio between a diameter of a circle having the same area as these faces, and the thickness, being the distance between the two major faces, equal to at least 2. Tabular grains are known in the photographic art for quite some time. As early as 1961 Berry et al. described the preparation and growth of tabular silver bromoiodide grains in Photographic Science and Engineering, Vol 5, No. 6. A discussion of tabular grains appeared in Duffin, Photographic Emulsion Chemistry, Focal Press, 1966, p. 66–72. Early patent literature includes Bogg, U.S. Pat. No. 4,063,951, Lewis U.S. Pat. No. 4,067,739 and Maternaghan U.S. Pat. Nos. 4,150,994; 4,184,877 and 4,184,878. However the tabular grains described therein cannot be regarded as showing a high diameter to thickness ratio, commonly termed aspect ratio. In a number of U.S.-Patent Applications filed in 1981 and issued in 1984 tabular grains with high aspect ratio and their advantages in photographic applications are described as in U.S. Pat. Nos. 4,434,226; 4,439,520; 4,425,425; 4,425,426 and in Research Disclosure, Volume 225, January 1983, Item 22534.

For radiographic applications the main photographic advantages of tabular grains compared to normal globular grains are a high covering power at high forehardening levels, a high developability and higher sharpness, especially in double side coated spectrally sensitized materials. The thinner the tabular grains the greater these advantages.

In the references on tabular grains cited above especially silver bromide or silver bromoiodide emulsions having a high sensitivity are disclosed whereas the use of e.g. emulsions with tabular grains rich in silver chloride was considered to be disadvantageous with respect to sensitivity. For emulsions with crystals rich in silver chloride, applications in the field of less sensitive materials as e.g. graphic arts materials, duplicating materials, radiographic hardcopy materials, diffusion transfer reversal materials and black-and-white or colour print materials are well-known. The advantages of said emulsions with crystals rich in chloride regarding higher development and fixing rates, are highly appreciated. Indeed as nowadays the tendency is present to get materials processed in shorter processing times, it is highly appreciated to combine said advantages with a high sensitivity for application in high-sensitive materials, an object which can be realized as has been described in EP-A 0 678 772.

Just as in applications mentioned hereinbefore in the field of industrial radiography, especially for non-destructive testing applications, any time saving measure is welcome: after exposure with direct-röntgen rays, industrial non-destructive testing film is automatically processed in a cycle, varying from 8 to 12 minutes, wherein the tendency is to reduce the processing time to a maximum of 5 minutes. One method to reach that goal has been described in U.S. Pat. No. 5,397,687 wherein cubic silver halide crystals rich in chloride are used, permitting further a decreased fixing time for the non-developed silver halide crystals rich in silver chloride in a still acceptable short time. Rapid processing of silver halide crystals rich in chloride however leads to high contrast and a higher noise level (more granularity).

Otherwise silver cubic bromoiodide grains, although having a slower development rate, are used preferably in NDT-applications for the following reason. In order to achieve high film speed, which is an indispensible asset especially for direct-röntgen applications, efficient absorption of the exposure radiation is a prime condition. It has been shown empirically that for X-rays the mass absorption coefficient is proportional to a power of the atomic number Z as has been described in the "Encyclopaedic Dictionary of Physics"vol. 7, p. 787, eq. 10, Ed. J. Thewlis, Pergamom Press, Oxford 1957. This strongly disfavours the use of chloride (Z=17) compared to bromide (Z=35) or iodide (Z=54). As a consequence bromide and iodide ions released in the developer further inhibit development of the remaining developable silver halide crystals, so that the regeneration capacity (replenishment) of the developer should be increased resulting in consumption of higher amounts of chemicals, a higher cost and more environmental load.

One method to reduce processing time and consumption of chemicals consists in lowering coated amounts of silver. A reduction of sensitivity for direct-Röngten rays normally leads to a lowering in contrast, which is in favour of image quality (especially graininess) but makes maximum density decrease to an unacceptable level. When moreover only use can be made of radiation sources for X-rays having a lower energy output (exposure energies of about 100 kVp instead of the normally used 220 kVp) a higher exposure contrast further leads to even higher contrasts and reduced speed. Although said reduced speed can be compensated in industrial radiographic exposure techniques by application of intensifying screens in contact with industrial non-destructive test film materials, thereby taking profit of the combined effect of direct-Röntgen exposure and exposure by light emitted from light-emitting phosphors present in the intensifying screens, the problem of too high contrasts remains. Moreover as a consequence of the presence of huge amounts of coated silver there is a tendency to sludge in the processing solutions as a consequence of a substantial contribution of physical development.

OBJECTS OF THE INVENTION

Therefore it is an object of the present invention to provide silver halide film materials suitable for industrial non-destructive testing applications wherein said film is exposed to X-rays having lower energy (about 100 kVp as applied e.g. in concrete tests) offering after processing, with a reduced tendency to sludge formation, sufficiently high speed and maximum density and a low contrast in order to provide excellent image quality (especially low graininess).

SUMMARY OF THE INVENTION

The above mentioned objects are realized by providing a black-and-white silver halide photographic material, said material comprising a support and on both sides thereof two light-sensitive emulsion layers and a protective antistress layer as an outermost layer, wherein per side of the support a total amount of silver, expressed as equivalent amount of silver nitrate of at least 5 g is coated, more preferably between 5 g and 15 g, wherein the light-sensitive emulsion layer more close to the said outermost layer is provided with at least one spectrally sensitized silver halide emulsion having tabular emulsion crystals with {111} or {100} major faces, and wherein the emulsion layer more close to the said support is provided with at least one non-spectrally sensitized emulsion having essentially cubic silver halide emulsion crystals, characterized in that the said cubic emulsion crystals or the said tabular emulsion crystals or both have a halide composition including bromide.

DETAILED DESCRIPTION OF THE INVENTION

It is understood that in the enumeration of possible halide compositions in the water-permeable hydrophilic light-sensitive silver halide emulsion layers of the material of the present invention the firstly called halide is present in the highest amount, expressed in mole %, and that the following halides are further present in decreasing amounts.

In the layer arrangement of the multilayer light-sensitive silver halide photographic negative image type material of the present invention it is clear that on both sides of the support following layers are consecutively present, starting from the support: a subbing layer, two light-sensitive emulsion layers of negative image type silver halide emulsions, wherein an emulsion layer is coated with one or more silver halide emulsions having mainly {100} cubic grains and, adjacent thereto and farther from the support an emulsion layer coated with one or more silver halide emulsions having mainly {100} and/or {111} tabular grains and a protective antistress layer as an outermost layer. An essential feature with respect to the halide composition of the emulsion crystals is that the said cubic emulsion crystals or the said tabular {100} and/or {111} emulsion crystals or both have a halide composition including bromide. In a preferred embodiment inclusion of bromide is such that bromide is present in the highest amount, expressed in mole %, in the cubic emulsion crystals, in the {100} and/or {111} tabular emulsion crystals or in both of them: the said silver bromoiodide, silver bromochloride or silver bromochloroiodide emulsion crystals having {111} (tabular) or {100} (cubic or tabular) major faces preferably have at least 50 mole % of bromide and still more preferably at least 75 mole % of bromide.

Preferably in the preparation step of the cubic silver halide crystals selected from the group consisting of silver chloride, silver chlorobromide, silver chloroiodide, silver chlorobromoiodide, silver bromide, silver bromoiodide or silver bromochloroiodide to be coated in the layer more close to the support of the multilayer material according to the present invention, the pAg range for the precipitation thereof is chosen so that the said emulsion crystals essentially have a cubic crystal habit. By "essentially cubic" is meant a grain which either is (a) perfectly cubic, or (b) cubic with rounded corners, or (c) cubic with small 111faces on the corners so that in fact a tetradecahedrical emulsion is obtained, the total area of these 111faces however being small compared to the total area of the 100faces. Moreover a cubo-octahedral shape is not excluded as the said shape depends on the effective pAg values applied during the precipitation of the said selected silver chloride, silver chlorobromide, silver chloroiodide, silver chlorobromoiodide, silver bromide, silver bromochloride, silver bromochloroiodide or silver bromoiodide crystals.

The precipitation of such cubic crystals can be principally performed by one double jet step; alternatively it may consist of a sequence of a nucleation step and at least one growth step. In the latter case, of the total silver halide precipitated preferably 0.5% to 5.0 mole % is formed during said nucleation step which preferably consists of an approximately equimolecular addition of silver and halide salts. The rest of the silver and halide salts is then added during one or more consecutive double jet growth steps. The different steps of the precipitation can be alternated by physical ripening steps. During the growth step(s) the flow rate of the silver salt and halide solutions can be kept constant; alternatively an increasing flow rate of silver salt and halide ion solutions can be established e.g. a linearly increasing flow rate. Typically the flow rate at the end is about 3 to 5 times greater then at the start of the growth step, without however being limited thereto. These flow rates can be monitored by e.g. magnetic valves. In a preferred embodiment of the present invention the essentially cubic emulsion is formed simply by one double jet step at a pAg maintained at a constant value between 7 and 10, and more preferably between 7 and 9, without separate nucleation step and at a constant flow rate. The constant pAg is realized by the use of a so-called "bypass solution" the addition of which is alternatingly switched on and off. The concentrations of the main silver salt and halide solutions typically range between 0.5 and 3 molar, and most preferably between 1 and 2 molar.

Preferably crystals of the essentially cubic emulsion have an average crystal diameter of from 0.1 to 1.5 $\mu$m, more preferably from 0.3 to 1.2 $\mu$m and still more preferably from 0.3 to 0.9 $\mu$m. Silver halide crystals used in the light-sensitive layer farther from the support of the multilayer material, prepared for use in the material according to the present invention, are thin tabular silver bromide, silver bromochloride, silver bromochloroiodide or silver bromoiodide emulsions or tabular silver chlorobromide, silver chlorobromoiodide or silver chloroiodide emulsions comprising grains rich in chloride, having at least 50 mole % of chloride and more preferably at least 75 mole % of chloride. In the light-sensitive silver halide emulsion layers of the material according to the present invention said tabular {111} or {100} silver halide emulsion crystals and said cubic crystals are containing iodide in an amount from 0.1 to 3 mole %.

The halide distribution in the cubic and in the tabular grains may be homogeneous over the whole crystal volume. When phases differing in silver halide composition are present over the crystal volume said crystal is said to have a core-shell structure. More than one shell can be present and between different phases it can be recommended to have a phase enriched in silver iodide by applying the so-called conversion technique during preparation. Iodide ions can be provided by using aqueous solutions of inorganic salts thereof as e.g. potassium iodide, sodium iodide or ammonium iodide. Iodide ions can also be provided by organic compounds releasing iodide ions as has e.g. been described in EP-A's 0 561 415, 0 563 701, 0 563 708,0 649 052 and 0 651 284.

Tabular silver halide emulsion crystals preferably have an average aspect ratio of at least 2:1, an average crystal thickness of less than 0.3 $\mu$m and account for at least 50%, more preferably at least 70% and still more preferably at least 90% of the total projected area of all grains. An average aspect ratio of at least 5:1 is even more preferred for a thickness of less than 0.25 $\mu$m, wherein tabular grains account for at least 50%, more preferably at least 70% and still more preferably at least 90% of the total projected area of all grains.

More specifically tabular silver halide grains rich in silver bromide or in silver chloride, bounded by {100} major faces and/or the preparation method thereof and/or materials in which said grains can be incorporated have been described in e.g. U.S. Pat. Nos. 5,024,931; 5,264,337; 5,275,930; 5,292,632; 5,310,635; 5,314,798; 5,320,938; 5,356,764; 5,491,056; 5,565,315; 5,607,828; in WO's 94/022051 and 96/013755; and in the published EP-A's 0 534 395, 0 569 971, 0 584 815, 0 584 644, 0 602 878, 0 616 255, 0 617 317, 0 617 320, 0 617 321, 0 617 325, 0 618 492, 0 653 669, 0 670 514, 0 670 515, 0 732 616, 0 762 192 and 0 767 400.

Otherwise tabular silver halide grains rich in silver bromide or in silver chloride, bounded by {111} major faces and/or the preparation method thereof and/or materials in which said grains are incorporated have been described in e.g. U.S. Pat. Nos. 4,399,215; 4,400,463; 4,804,621; 5,061,617; 5,176,991; 5,176,992; 5,178,997; 5,178,998; 5,183,732; 5,185,239; 5,217,858; 5,221,602; 5,264,337; 5,272,052; 5,275,930; 5,286,621; 5,292,632; 5,298,385; 5,298,387; 5,298,388; 5,310,644; 5,320,938; 5,356,764; 5,470,698; 5,492,801; 5,494,789; 5,576,172; 5,604,085; 5,612,176; 5,629,142 and in the published EP-A's 0 481 133, 0 503 700, 0 532 801, 0 533 189, 0 647 877, 0 678 772, 0 699 944, 0 699 946, 0 699 949, 0 701 164, 0 732 616 and 0 756 198.

At least one of said tabular or cubic grains may further be doped with whatever a dope as e.g. with group VIII metal ions like $Rh^{3+}$, $Ir^{4+}$, $Ru^{4+}$ and $Co^{2+}$ or with $Cd^{2+}$, $Zn^{2+}$ or $Pb^{2+}$ or even with a mixture thereof.

For the preparation of tabular silver bromide or bromoiodide crystals bounded by {111} major faces and materials comprising said crystals, EP-A 0 569 075 and the corresponding U.S. Pat. No. 5,595,864 is useful.

In one embodiment the objects of the present invention are attained by providing tabular silver bromide and bromoiodide crystals coated in an emulsion layer more close to the outermost protective antistress layer over a layer comprising essentially cubic silver bromide or silver bromoiodide emulsion crystals, having a preferred crystal size as disclosed hereinbefore.

The crystal size obtained at the end of the precipitation of silver halide grains depends on many factors as there are the amount of silver precipitated during the nucleation step, the initial concentration of reagents present in the reaction vessel, the flow rate of silver salt and halide salt solutions, the temperature, pAg, the presence of growth accelerators, etc. The same applies to the degree of monodispersity of the crystal distribution: preferably a variation coefficient (ratio of standard deviation and average grain size) of not more than 0.30 and even more preferred of at most 0.20 should be measured.

For tabular silver halide grains an average thickness over the total crystal population of less than 0.3 $\mu$m is thus preferred.

A thickness of less than 0.25 $\mu$m is more preferred and even still more preferred is a thickness of at most 0.20 $\mu$m. Even ultrathin crystals of from 0.06 $\mu$m up to 0.15 $\mu$m thick can be used. The average aspect ratio, defined as the ratio, calculated from the measurements of the equivalent diameter of a circle having the same surface area as the different individual grains, and its thickness, is preferably higher than 2:1; more preferably higher than 5:1 and still more preferably even up to 8:1 or even up to about 20:1.

Mixtures of the tabular crystals having {111} and/or {100} major faces can also be used just as mixtures of crystals having a tabular habit but a different halide composition or a cubic habit but a different halide composition, provided that crystals having the right crystal habit are located in the right emulsion layer. The presence however in minor amounts (up to at most 10% by weight) of cubic crystals in the emulsion layer substantially comprising tabular {100} and/or {111} is not excluded.

In accordance with the present invention mixtures of emulsions described hereinbefore can thus be used in the adjacent light-sensitive emulsion layers of the photographic material according to the present invention, provided that the layer farthest from the support contains a mixture of essentially tabular grains, whereas the layer more close to the support contains a mixture of essentially cubic grains and that the halide composition of the said cubic and/or of the said tabular emulsion crystals always includes bromide in a preferred amount of at least 50 mole % and even more preferably in an amount of at least 75 mole %. This restriction is due to the fact that the silver halide film materials according to the present invention are double-side coated industrial radiographic materials for non-destructive testing applications which are exposed to X-rays having lower energy (about 100 keV) and that those film materials should have a sufficiently high speed, maximum density and especially a suitably low contrast in order to provide excellent image quality, especially related with low graininess.

Emulsions having a different halide distribution over the grain volume or a different halide composition or emulsions having the same halide composition differing from one another in average crystal size can be mixed. The said emulsions differing from each other in grain size only, further having the same halide composition, can be obtained from the same fine silver halide "mother" emulsion nuclei. By addition of different amounts of silver salt and halide salt solutions or by applying different physical ripening times such emulsions having crystals different in size can be obtained.

In one embodiment of the present invention at the end of the emulsion preparation process the emulsion is made free from excess of soluble inorganic salts by a conventional wash technique e.g. flocculation by ammonium sulphate or polystyrene sulphonic acid, followed by several washing steps and redispersion. Another well-known wash technique is ultrafiltration. Finally extra gelatin can be added to the emulsion in order to obtain the desired gelatin to silver ratio.

In accordance with the present invention the tabular silver halide emulsions to be coated in a hydrophilic layer farther from the support (more close to the outermost protective antistress layer) are chemically sensitized. The same applies to the cubic silver halide emulsions to be coated in a hydrophilic layer more close to the support.

Chemical sensitization procedures are described e.g. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesell-schaft (1968). As described in said literature chemical sensitization can be carried out by effecting the ripening in the presence of small amounts of compounds containing sulphur, selenium or tellurium e.g. thiosulphate, thiocyanate, thioureas, selenosulphate, selenocyanate, selenoureas, tellurosulphate, tellurocyanate, sulphites, mercapto compounds, and rhodamines. The emulsions may be sensitized also by means of gold-sulphur ripeners or by means of reductors e.g. tin compounds as described in GB-Patent 789,823, amines, hydrazine derivatives, formamidine-sulphinic acids, and silane compounds. Chemical sensitization can further proceed with sensitizing agents well-known in the art. It can proceed by means of a reduction sensitizer, a noble metal salt such as a gold salt together with a reduction sensitizer, a sulphur and/or a selenium sensitizer, a high pH-value and a low pAg-value.

A combination of gold salt(s), sulphur and selenium compounds may therein offer a good fog-sensitivity relationship. Reduction sensitization causing fog can e.g. be attained by reduction with a strong reducing agent which introduces small specks of metallic silver onto the silver halide crystals, preferably on those having a cubic habit. Examples of especially useful compounds having reducing properties are e.g. thioureumdioxide, tin compounds as described in GB-A 789,823, amines, hydrazine derivatives, formamidine sulphinic acids and silane compounds and the like.

Whereas the essentially cubic silver halide grains are not spectrally sensitized, the tabular silver halide emulsion crystals having a large specific surface of {100} or {111} major faces available are spectrally sensitized in the wavelength range comprised between 350 and 500 nm as prior to chemical ripening one or more spectral sensitizer(s) is(are) added in order to provide site-direction of the chemical sensitizers.

Spectral sensitization may proceed with methine dyes such as those described by F. M. Hamer in "The Cyanine Dyes and Related Compounds", 1964, John Wiley & Sons. Further a survey of useful chemical classes of spectral sensitizing dyes and specific useful examples in connection with tabular grains is given in Research Disclosure Item 22534. A more recent practical overview is e.g. given in EP-A 0 757 285. Particularly valuable dyes that can be used for the purpose of spectral sensitization as cyanine dyes, merocyanine dyes and complex merocyanine dyes are broadening the spectral region to which the light-sensitive silver halide crystals are sensitive in order to capture the light emitted from the light source, as non-spectrally sensitized silver halide crystals used in the process for preparing a multilayer material according to the present invention are only sensitive in the ultraviolet and blue region of the spectrum. According to the present invention the spectrally sensitized tabular silver halide crystals are sensitized in the wavelength range comprised between 350 and 500 nm. Specifically preferred blue sensitizers for tabular silver halide grains as zeromethinemerocyanine dyes and/or monomethine cyanine dyes have been disclosed e.g. in EP-A's 0 622 665 and 0 712 034, wherein the film has been combined with a ultra violet-blue emitting conversion screen or panel. When combined with an intensifying screen emitting ultraviolet-blue radiation the direct-X-rays together with the ultraviolet-blue light from the intensifying screens provides illumination of the film material of the present invention and allows lower total coating amounts of silver in order to reach the same speed, if compared with films which are only sensitive to direct X-rays, although an enhanced speed has therefore also been provided by making use of a lead foils or screens. Specific intensifying screens emitting ultraviolet-blue radiation suitable for use in the present invention have e.g. been disclosed in U.S. Pat. Nos. 4,225,653; 4,387,141; 4,710,637; 5,112,700; 5,173,611 and 5,432,351; in EP-A's 0 650 089; 0 658 613; in PCT-Applications WO 93/11457 and WO 95/15514.

Typical blue-UV emitting phosphors therein are tantalates as described in PCT-Applications WO 93/1521 and 93/1522, hafnates as described in U.S. Pat. No. 5,173,611 and fluorohalides (fluorobromides) of barium and strontium as in WO 91/1357 and U.S. Pat. No. 5,629,125, doped with europium and co-doped with samarium as in U.S. Pat. Nos. 5,422,220 and 5,547,807 and even mixtures of tantalates and fluorohalides as in U.S. Pat. No. 5,077,145 and EP-A 0 533 234, replacing $CaWO_4$ as representative for an older well-known generation of luminescent phosphors.

In EP-A 0 820 069 particles of niobium doped, monoclinic M, yttriumtantalate phosphor and particles of an europium doped bariumfluorohalide phosphor are composing the screen.

As already set forth hereinbefore spectral sensitization, in connection with tabular grains used in emulsions coated in the light-sensitive layer farthest from the support, may occur simultaneously with or may even precede completely the chemical sensitization step as in that case the chemical sensitization occurring after spectral sensitisation is believed to take place at one or more ordered discrete sites of tabular grains. This may also be done with the emulsions used in materials of the present invention, wherein the chemical sensitization proceeds in the presence of one or more phenidone and/or derivatives, a dihydroxy benzene as hydroquinone, resorcinol, catechol and/or a derivative(s) therefrom, one or more stabilizer(s) or antifoggant(s), one or more spectral sensitiser(s) or combinations of said ingredients. Especially 1-p-carboxy-phenyl, 4,4' dimethyl-3-pyrazolidine-1-one may be added as a preferred auxiliary agent.

Other dyes, which per se do not have any spectral sensitizing activity, or certain other compounds, which do not substantially absorb visible radiation, can have a supersensitization effect when they are incorporated together with said spectral sensitizing agents into the emulsion. Suitable supersensitizers are, i.a., heterocyclic mercapto compounds containing at least one electronegative substituent as described e.g. in U.S. Pat. No. 3,457,078, nitrogen-containing hetero-cyclic ring-substituted aminostilbene compounds as described e.g. in U.S. Pat. No. 2,933,390 and in U.S. Pat. No. 3,635,721, aromatic organic acid/formaldehyde condensation products as described e.g. in U.S. Pat. No. 3,743,510, cadmium salts, and azaindene compounds.

At least one non-spectrally sensitizing dye can be added as a filter dye to at least one of the adjacent emulsion layers of the materials according to this invention, or to one or more non-light-sensitive hydrophilic layers. The presence of said dye(s) in adapted amounts in at least one hydrophilic layer is not only recommended to adjust the sensitivity of the different emulsion layers and the required contrast, but also in order to reduce scattering of exposure radiation and thus to enhance sharpness. Preferred dyes are those that can be removed relatively easily in aqueous alkaline processing liquids and that can diffuse sufficiently fast throughout hydrophilic colloid layers in said processing. During coating of the hydrophilic layers comprising said dye(s), it is clear that said dye(s) should be non-diffusable. Said dyes are also called antihalation or filter dyes and are widely used in photographic elements in order to absorb reflected and scattered light. Examples of the said dyes have been described e.g. in U.S. Pat. Nos. 3,560,214; 3,647,460, 4,288,534, 4,311,787.4,857,446; 5,344,749; 5,478,708 and 5,502,205.

Once a filter dye has been selected, the problem is how to get the filter dye in a coated layer so that all the requirements mentioned previously are met. One of the preferred possibilities is to make use of solid particle dispersions of water insoluble dyes as has been described in EP-A's 0 586 748, 0 587 230 and 0 656 401, 0 401 709; 0 384 633; 0 323 729; 0 274 723; 0 276 566; 0 351 593; in U.S. Pat. Nos. 4,900,653; 4,904,565; 4,949,654; 4,940,654; 4,948,717; 4,988,611; 4,803,150 and 5,344,749 and in Research Disclosure 19551 (July 1980), wherein these examples should not considered to be limitative. Another possibility consists in preparing said dyes in the form of a solid silica particle dispersion as disclosed in EP-A 569 074. Still another possibility to obtain ultra fine dye dispersions consists in acidifying a slightly alkaline coating composition "in situ" just before coating it onto the supporting layer. It has been found that the application of this dosage technique allows us to obtain the dyes in a very fine solid particle form, homogeneously divided into the coated layer so that solid particles can hardly be observed even by means of microscopic techniques.

Monomethine dyes have an absorption spectrum of which the maximum is in the shorter wavelength range of the visible spectrum so that normally a second filter dye is needed to block or absorb green light and even a third one to absorb radiations of longer wavelengths e.g. radiations in the red or even in the infrared region. The non-diffusing dyes added to a hydrophilic layer of a photographic element as a solid particle has a mean diameter of less than 10 $\mu$m, more preferably less than 1 $\mu$m and still more preferably less than 0.1 $\mu$m. At a pH of at least 10 the dispersed filter dyes are easily solubilized so that they are removed almost completely from a hydrophilic water-permeable colloid layer of a photographic silver halide emulsion material by its common alkaline aqueous liquid processing and leave almost no residual stain. The presence of sulphite in the processing solution contributes to a more rapid discoloration of the filter dyes. The dye(s) incorporated in the emulsion layer(s) of the multilayer material prepared according with the present invention preferably have the general structure (I)

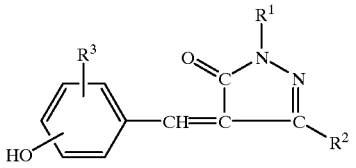

in which $R^1$ is hydrogen, alkyl, substituted alkyl, aryl, substituted aryl, aralkyl or substituted aralkyl, $R^2$ is carboxy, alkoxycarbonyl, aryloxycarbonyl, carbamoyl, ureido, sulphamoyl or one of the groups represented by $R^1$; at least one of $R^1$ and $R^2$ being or containing carboxy or carbamoyl, $R^3$ is hydrogen, $C_1$–$C_4$ alkyl or $C_1$–$C_4$ alkoxy, and when $R^3$ is alkyl or alkoxy it stands in ortho or para in respect of the hydroxy group, which itself is in ortho or para in respect of the methine group; said merostyryl dye containing further no group that renders the dye soluble in the hydrophilic colloid layer.

Although preferably present in at least one emulsion layer of the multilayer material according to the present invention, the same or other dye(s) can be present in an antihalation undercoat layer (e.g. between the subbing layer and the emulsion layer having cubic emulsion grains), an intermediate layer (e.g. between light-sensitive emulsion layers or between the emulsion layer having tabular grains and the protective antistress layer) and/or a protective outermost layer, depending on the requirements. The silver halide emulsion for use in the multilayer material according to the present invention may comprise compounds preventing the formation of a high minimum density or stabilizing the photographic characteristics during the production or storage of photographic elements or during the photographic treatment thereof. Many known compounds can be added as fog-inhibiting agent or stabilizer to the silver halide emulsion. Suitable examples are i.a. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JP-B 77/031738, and GB-A 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid, benzenethiosulphonic acid amide. Other compounds that can be used as fog-inhibiting compounds are those described in Research Disclosure (RD) No. 17643 (1978), Chaptre VI and in RD No. 38957 (1996), Chapter VII. Fog-inhibiting agents or stabilizers can be added to the silver halide emulsion prior to, during, or after the ripening thereof and mixtures of two or more of these compounds can be used.

In the preparation of emulsions according to the present invention use can be made of a special oxidized gelatin or of a synthetic peptiser. Conventional lime-treated or acid treated gelatin can be used. The preparation of such gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, No. 16, page 30 (1966). Before and during the formation of the silver halide grains it is common practice to establish a gelatin concentration of from about 0.05% to 5.0% by weight in the dispersion medium. Additional gelatin is added in a later stage of the emulsion preparation e.g. after washing, to establish optimal coating conditions and/or to establish the required thickness of the coated emulsion layer. Preferably a gelatin to silver halide weight ratio ranging from 0.3 to 1.0 is then obtained. Another binder may also be added instead of or in addition to gelatin. Useful vehicles, vehicle extenders, vehicle-like addenda and vehicle related addenda have been described e.g. in Research Disclosure No. 38957 (1996), Chapter II.

The gelatin binder of the photographic elements can be forehardened with appropriate hardening agents such as those of the epoxide type, those of the ethylenimine type, those of the vinylsulfone type, e.g., 1,3-vinylsulphonyl-2-propanol or di-(vinylsulphonyl)-methane, vinylsulphonyl-ether compounds, vinylsulphonyl compounds having soluble groups, chromium salts like e.g. chromium acetate and chromium alum, aldehydes as e.g. formaldehyde, glyoxal, and glutaraldehyde, N-methylol compounds as e.g. dimethylolurea and methyloldimethylhydantoin, dioxan derivatives e.g. 2,3-dihydroxydioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in EP-A 0 408 143.

Prior to coating any thickening agent may be used in order to regulate the viscosity of the coating solution, provided that they do not particularly affect the photographic characteristics of the silver halide emulsion in the coated photographic material. Preferred thickening agents include aqueous polymers such as polystyrene sulphonic acid, dextran, sulphuric acid esters, polysaccharides, polymers having a sulphonic acid group, a carboxylic acid group or a phosphoric acid group as well as colloidal silica. Polymeric thickeners well-known from the literature resulting in thickening of the coating solution may even be used in combination with colloidal silica. Patents concerning thickening agents are e.g. U.S. Pat. No. 3,167,410; Belgian Patent No. 558.143 and JP-A's 53-18687 and 58-36768. Negative effects on physical stability possibly resulting from the addition of polymeric compounds can be avoided by exclusion of those compounds and by restricting extra additions of colloidal silica. In order to coat hydrophilic colloidal layer compositions on a support by slide-hopper or curtain-coating techniques, wherein said compositions have gelatin in low amounts in order to provide a ratio by weight of gelatin to silver halide expressed as an equivalent amount of silver nitrate in the range from 0.05 to 0.4, thickening agents composed of synthetic clay and anionic macromolecular polyelectrolytes wherein said synthetic clay is present in an amount of at least 85% by weight versus the total amount of thickening agents are recommended as disclosed in EP-Application No. 96201653, filed Jun. 13, 1996.

The photographic element may further comprise various kinds of coating physical property modifying addenda as described in Research Disclosure No. 38957 (1996), Chapter IX, wherein coating aids, plasticisers and lubricants, antistats and matting agents have been described.

The photographic element of the present invention may comprise various kinds of surface-active agents in the photographic emulsion layer or in at least one other hydrophilic colloid layer. Suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g higher contrast, sensitization, and development acceleration.

Development acceleration can be accomplished by incorporating in emulsion layer(s) or adjacent layers various compounds, preferably polyalkylene derivatives having a molecular weight of at least 400 such as those described in e.g. U.S. Pat. Nos. 3,038,805; 4,038,075 and 4,292,400 as well as in EP-A's 0 634 688 and 0 674 215.

The protective antistress layer as a non-light-sensitive layer of the material according to the present invention may further comprise various additives like surfactants, matting agents, lubricants, thickening agents, bactericides, antistatic agents, etc., most of which have already been mentioned hereinbefore. To the protective topcoat layer(s) one or more hardening agents may be added, preferably just before coating said layer(s). The same hardeners can be used as summarised hereinbefore. Further one or more non-spectrally sensitizing dyes as discussed hereinbefore can be added thereto, preferably during coating, in order to controll the sensitivity of the coated material.

Advantages offered by the method to prepare a multilayer material according to the present invention are related to the main object to obtain a suitable speed, gradation and maximum density. Further the coated amount of silver, expressed as the equivalent amount of silver nitrate, can be reduced to amounts of e.g. less than 20 g/m$^2$ and still more preferably from 8 to 16 g/m$^2$. Higher amounts are particularly preferred in materials showing a higher sensitivity and contrast.

The support of the photographic material is a transparent resin support. It is also possible to use an organic resin support e.g. cellulose nitrate film, cellulose acetate film, poly(vinyl acetal) film, polystyrene film, poly(ethylene terephthalate) film, poly(ethylene naphthalate), polycarbonate film, polyvinylchloride film or poly-α-olefin films such as polyethylene or polypropylene film. The thickness of such organic resin film is preferably i D comprised between 0.07 and 0.35 mm. These organic resin supports are preferably coated with a subbing layer which can contain water insoluble particles such as silica or titanium dioxide. The support of the photographic material according to the present invention is a transparent resin, preferably a blue coloured polyester support like polyethylene terephthalate. This blue colored support makes minimum density enhance as a function of the amount of blue dye incorporated into said support. The support is further provided with a substrate layer at both sides to have good adhesion properties between the adjacent layers and said support: one or more subbing layers known to those skilled in the art for adhering thereto a hydrophilic colloid layer may be present. Suitable subbing layers for polyethylene terephthalate supports are described e.g. in U.S. Pat. Nos. 3,397,988, 3,649,336, 4,123,278 and 4,478,907. The subbing layer composition of the material according to the present invention preferably comprises as a latex copolymer vinylidene chloride, methylacrylate and itaconic acid. In a more preferred embodiment said subbing layer comprises a polyethylene dioxythiophene compound as an antistating agent. Said subbing layer comprising a polythiophene compound has a particularly suitable antistatic working as it has electronic conductive properties. More particularly for materials according to the present invention a polyethylene dioxythiophene compound should be present in the subbing layer coated onto the support as disclosed e.g. in U.S. Pat. Nos. 5,312,681 and 5,391,472.

The material according to the present invention is a double-side coated industrial radiographic material, coated with a total amount of silver, expressed as an equivalent amount of silver nitrate, of from 5 g/m$^2$ up to 15 g/m$^2$ and is preferably exposed with an X-ray radiation source having an energy output of from 50 keV up to 5 MeV, i.e. suitable for a dedicated application in the field of industrial radiography. So the photographic material according to the present invention is image-wise exposed by X-rays, by radiation originating from radioactive isotopes from iridium and cobalt as e.g. $Co^{60}$, by selenium-sources etc.

Specific applications for the material according to the present invention are related with concrete testing and flash X-ray.

Total amounts of silver coated coated are at least 5g/m$^2$ and more preferably from 5 to 15 g/m$^2$.

In a preferred embodiment X-ray conversion screens are used in a film-screen system wherein X-rays are absorbed by phosphor particles coated in the phosphor layer(s) of the screen. Said X-rays are converted into radiation having a wavelength for which the silver halide crystals coated in the layers of the light sensitive silver halide film material has been made sensitive. In said film-screen system the screen(s)

is(are) brought into intimate contact with each side of the film material having emulsion layers in order to obtain a good image quality, especially sharpness, accompanied by low noise due to an excellent graininess offered by the specific layer composition of the multilayer photographic material according to the present invention.

Said film-screen system can be a symmetrical or an asymmetrical system. Symmetrical systems are well-known as these are characterized by the presence of the same emulsion layers and other auxiliary layers at both sides of the support, in contact with the same phosphor plates. Asymmetrical film-screen systems may be composed of identical emulsion layers at both sides of the support but different phosphor plates e.g. phosphor plates differing in phosphor composition, phosphor grain sizes or grain size distributions, phosphor coating amounts, etc., and combinations of all those measures, thus leading to different screen speeds. Examples thereof can be found in e.g. U.S. Pat. Nos. 1,925,546; 4,835,396; 5,069,982 and 5,259,016; in JP-A's 06/130575 and 06/130577 and in EP-A's 0 232 888 and 0 633 497. Asymmetrical film-screen systems may be composed of identical screens in contact with both film sides comprising emulsion layers having different sensitivities, due to different silver halide compositions of the respective layers, due to differences in silver halide grain size or grain size distribution, due to differences in coating amounts, etc., and combinations of all these measures, leading to different speeds and/or contrasts of the emulsion layers at both sides of the film support, provided that the required speed level is attained in combination with a relatively low contrast as requested for this dedicated application. Examples thereof can be found e.g. in U.S. Pat. Nos. 4,994,355; 5,021,327; 5,252,443; 5,380,636 and 5,399,470; in JP-B 77/018580; in JP-A's 04/235545; 04/125626 and 04/145427 and in EP-A's 0 440 367; 0 449 101 and 0 530 117. Further in the screen-film system, both films and screens may be asymmetrical as has been illustrated, e.g., in DE 1 000 687; in DD 00 237 010; in U.S. Pat. Nos. 4,978,599; 5,070,248; 5,238,795; 5,259,016; 5,354,648 and 5,380,636; and in EP-A's 0 384 634; 0 437 117; 0 524 650; 0 577 027; 0 581 065 and 0 627 744.

After exposure of the film, processing conditions and composition of processing solutions may be chosen as a function of the specific type of multilayer material according to the present invention. For example, in a preferred embodiment of materials for X-ray diagnostic purposes, after exposure of the film-screen system by X-rays, said material is subjected to processing. Preferably an automatically operating processing apparatus is used provided with a system for automatic regeneration of the processing solutions. Forehardened material may be processed using one-part package chemistry or three-part package chemistry, depending on the processing application determining the degree of hardening required in said processing cycle. The processing of the photographic material according to the method of the present invention comprises the steps of developing, fixing, rinsing and drying.

An image is thus formed by providing, according to the present invention, an image-forming system wherein the material according to the present invention as described hereinbefore in contact with intensifying screens at both sides of the film material is subjected to the steps of exposing with an X-ray radiation source having an energy output of from 50 keV up to 5 MeV, processing comprising the steps of developing, fixing, rinsing and drying.

For processing, preferably an automatically operating apparatus is used provided with a system for automatic replenishment of the processing solutions. Processing times may vary between 90 seconds and 12 minutes, but more preferably it takes no longer than 5 minutes to run throughout the whole processing cycle. Non-automatic tray development, also called dish or scale development, is however not excluded.

Film materials in accordance with the present invention may be processed in developer solutions of different compositions as e.g. hydroquinone-1-phenyl-3-pyrazolidinone, 1-phenyl-3-pyrazolidinone-erythorbic acid, (iso)ascorbic acid, 1-ascorbic acid, reductic acid or derivatives thereof, wherein a development composition as e.g. in U.S. Pat. No. 5,397,687 or in EP-A 0 757 286 may be used.

An amount of potassium thiocyanate in the range of 0.1 to 10 g per liter of the developer solution is recommended in order to obtain high gradation values. An amount of 25 to 250 mg of potassium iodide per liter is particularly recommended in order to obtain a higher speed.

The developer solution used in the developing step according to the method of the present invention should be replenished not only for decrease of the liquid volume due to cross-over into the next processing solution, but also for pH-changes due to oxidation of the developer molecules. This can be done on a regular time interval basis or on the basis of the amount of processed film or on a combination of both. The development step can be followed by a washing step, a fixing solution and another washing or stabilization step.

In order to reduce silver contamination to minimum levels it is recommended to add alkylthio mercaptothiadiazoles, alkyl mercaptans, mercapto benzimidazoles, mercapto hydroxy pyrimidines and, more preferred dylfides to the developer as has been described in e.g. JP-A's 08-278609, 07-311430, 03-051844 and 03-055541, in EP-A's 0 768 568 and 0 593 262 and in U.S. Pat. Nos. 5,506,092 and 5,648,205. Specific products as aliphatic, cycloaliphatic, aromatic or heterocyclic di- or trisulfides manufactured by Ciba-Geigy under the trade name IRGAFORM (see especially 3,3' dithiobis(3,3'-diphenyl)-propionic acid, known as IRGAFORM 1007) had already been described before in U.S. Pat. No. 4,141,734, for particular use in the developer.

In the alternative, the said agents can be added to the silver halide photographic material as in JP-A 03-132649 and in U.S. Pat. No. 4,699,873 or to both of the silver halide photographic material and the developer as has e.g. been described in JP-A 07-056284.

It is particularly preferred that the protective antistress layer and/or to at least one emulsion layer of the industrial radiographic material according to the present invention comprise(s) a disulfide compound, and more preferably a compound according to the formula

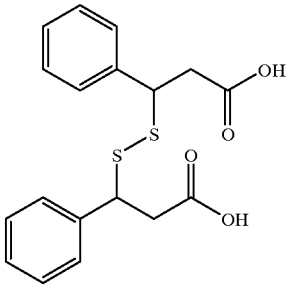

in order to prevent silver sludge formation to occur, as for those films total coated amounts of silver from 5 g to 15 g per sq.m. are relatively high.

It is even more preferred, according to the image forming system according to the present invention, that the developer comprises a disulfide, and more preferably 3,3' dithiobis(3,3'-diphenyl)-propionic acid.

For film materials in accordance with the present invention it is possible to use sodium thiosulphate as a fixing agent, thus avoiding the ecologically undesired ammonium ions normally used. When aluminum salts are used as hardening agents in the fixer solution and when there is no rinsing step between developer and fixer unit, it is recommended to make use of an ascorbic acid type developer as has been set forth in EP-Application 97203096, filed Oct. 6, 1997. A method to provide an ecologically favourable minimization of silver content in the washing solution, which may be advantageously applied in the context of the present invention, without impairing the processing speed, without enhancing processing costs and without excessive regeneration has been given in Ep-Application No. 98200319, filed Feb. 3, 1998. Finally after the last washing step the photographic material is dried.

The following Examples are illustrating the invention, without however limiting it thereto.

EXAMPLES

Preparation of Tabular Emulsion T

To a solution of 5.5 g of oxidized gelatin (less than 30 μmole methionine per g) in 3 water, adjusted to a pBr of 2.4 by adding KBr and a pH of 1.7 by adding $H_2SO_4$, were added by a double jet method aqueous solutions of 1.96 M $AgNO_3$ (hereinafter referred to as S1) and 1.96 M KBr (hereinafter referred to as S2) both at a constant flow rate of 16 ml/min during 27 seconds. During this period, the reaction mixture was maintained at 51° C. When the addition was completed, stirring continued during 1.5 minutes and then, temperature was increased up to 70° C. over a period of 25 minutes, followed by addition of a NaOH solution over a period of one minute in order to adjust pH to a value of 5.6. Then stirring continued for 2.5 minutes and 0.5 of a 10% gelatin solution kept at 70° C. was added. After stirring during another 5.5 minutes, S2 was added in a single jet at 7.5 ml/min over a period of 5.5 minutes. Then S1 at a constant flow rate of 7.5 ml/min and S2 at a flow rate, controlled in order to maintain pAg at 8.9, were added by double jet addition over a period of 1 minute. This double jet was continued during another period of 33 minutes and 23 seconds, while the flow rate of S1 was linearly increased up to 23.1 ml/min and pAg was maintained at 8.9. 5 minutes after the completion of said double jet addition, S1 was added at 7.5 ml/min during 7 minutes and 20 seconds. Then another double jet started of S1 at 7.5 ml/min during 1 minute and 40 seconds and an aqueous solution of 1.93 M KBr and 0.03 M KI at a controlled flow rate in order to maintain pAg at 7.4. This double jet was continued during another period of 40 minutes and 56 seconds, while the flow rate of S1 was linearly increased up to 36.8 ml/min and pAg was maintained at 7.4. The average grain size of the emulsion thus prepared was 0.78 μm, the average thickness was 0.22 μm and the variation coefficient was 0.30. The iodide content was 1 mole %.

After washing, gelatin and water were added in order to obtain a silver halide content of 245 g/kg, expressed as $AgNO_3$, and a gelatin content of 83 g/kg. To 2 kg of this emulsion, of which pH was adjusted to 5.5, were consecutively added 4 ml of a 10 wt. % of a KSCN solution, 0.2 ml of a $4.76\times10^{-3}$ M solution of sodium toluene thiosulphonate in methanol, 1170 ml of a 0.25 wt. % solution of 3-ethyl-5-[1-(4-sulfobutyl)-4-(1H)-pyridylidene] rhodanine, 9 mg sodium thiosulphate, 5.3 ml of a solution containing $1.46\times10^{-3}$ M chlorauric acid and $1.58\times10^{-2}$ M ammonium thiocyanate, and finally 10 ml of a 1 wt. % solution of 1-(p-carboxyfenyl)-5-mercapto-tetrazole and this mixture was chemically ripened during 4 hours at 48° C. After cooling, a preservative was added.

Preparation of Cubic Emulsion C

To 1 of a solution, containing 15 g of methionine and 50 g of gelatin, adjusted to pH 5.8 and kept at 60° C., were added in a double jet a 2.94 M $AgNO_3$ solution at a constant flow rate of 3.35 ml/min during 5 seconds and a solution of 2.91 M KBr and 0.03 M KI at a flow rate controlled in order to maintain pAg constant at 7.8. Then the flow rate of the $AgNO_3$ solution was increased linearly up to 21 ml/min during 72 minutes and 46 seconds. The cubic grains thus prepared consisted of 99 mole % of AgBr and 1 mole % of AgI with an average grain size of 0.80 mm and was called emulsion C8. After washing, gelatin and water were added in order to obtain a silver halide content of 208 g/kg, expressed as $AgNO_3$, and a gelatin content of 83 g/kg. To 2.4 kg of this emulsion, of which pH was adjusted to 6.0, were added consecutively 6 mg of sodium thiosulphate, 70 ml of a solution containing $1.46\times10^{-3}$ M chloro auric acid and $1.58\times10^{-2}$ M ammonium thiocyanate, 2 ml of a $4.76\times10^{-3}$ M solution of sodium toluene thiosulphonate in methanol and 38 mg sodium sulphite. This mixture was chemically ripened during 4 hours at 46° C. After cooling, a preservative was added.

Cubic emulsions C7 and C5 were prepared according to the same procedure as described for emulsion C8 but with adjusted flow rates during the nucleation step in order to obtain crystals with an average grain size of 0.56 μm and 0.42 μm respectively.

TABLE 1

| Compound (amounts per mole silver halide) | Upper emulsion layer B | Lower emulsion layer A |
|---|---|---|
| 3-ethyl-5-[1-(4-sulfobutyl)-4-(1H)-pyridylidene]rhodanine | 200 mg [a] | |
| 4-hydroxy-6-methyl-1,3,3a,7-tetraazaindene | 87 mg | 785 mg |
| bis-metasulphophenyl-disulphide | — | 50 mg |
| 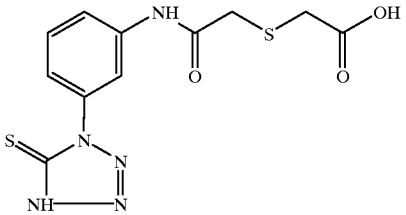 | 33 mg | — |

TABLE 1-continued

| Compound (amounts per mole silver halide) | Upper emulsion layer B | Lower emulsion layer A |
|---|---|---|
| sorbitol | 15.5 g | 15.5 g |
| polyethylacrylate, latex platiciser | 12 g | 12 g |
| phloroglucinol | 195 mg | 39 mg |
| resorcinol | 2.8 g | 2.8 g |
| potassium bromide | 160 mg | 160 mg |
| polydextran (M.W. 10,000) | 15 g | 40 g |

[(a)]an extra amount of 200 mg was added for preparing the coating solution of upper emulsion layer B of example No. 1 which contains no tabular emulsion T1 in said layer.

TABLE 2

| Compound | amounts per $m^2$ |
|---|---|
| gelatin | 1.1 g |
| polymethylmethacrylate spacing agent (average particle diameter 3 mm) | 15 mg |
| chromium acetate | 5.5 mg |
| 4-hydroxy-6-methyl-1,3,3a,7-tetraazaindene | 82 mg |
| bis—metasulphophenyl—disulphide | 4 mg |
| $CF_3$—$(CF_2)_6$—COOH.NH3 | 7.5 mg |
| $CF_3$—$(CF_2)_6$—CONH—$(CH_2CH_2O)_{17-20}$—H | 19 mg |
| phenol | 150 mg |
| 1-phenyl-4-methyl-3-pyrazolidone | 0.13 mg |
| Mobilcer Q (a paraffin wax, trade name product from MOBIL OIL) | 25 ml |
| polythioether A [(a)] | 5 mg |
| formaldehyde (added just before coating) | 100 mg |

[(a)] Polythioether A is a modified poly-epichloorhydrine having an average chain length of approximately 20 monomer units and of which about 50% of the chloride groups have been replaced by a —S—$CH_2$—CHOH—$CH_2$OH substituent.

Coating of the Materials

The photographic materials according to these examples comprise two emulsion layers and one protective layer, coated symmetrically in the same way at both sides of a blue colored polyethylene terephthalate support having a total density of 0.80. The coating solutions of the emulsion layers were prepared by adding solutions of the compounds indicated in Table 1 to the emulsions dissolved while warming and stirring. The coating solution of the protective layer is given in Table 2. After adjusting the pH to 6.7, the viscosity and surface tension of the coating solutions were optimized according to the requirements of the coating method. The emulsion layer(s) and the protective layer were coated simultaneously on one side of a substrated polyester support having a thickness of 175 $\mu$m by means of conventional coating techniques. the silver coverage of the emulsions is given in following Table 3.

TABLE 3

| | Emulsion coating weights (g/$m^2$ $AgNO_3$) | | | | | | | | |
|---|---|---|---|---|---|---|---|---|---|
| | Upper emulsion layer B | | | Lower emulsion Layer A | | | Sensitometric results | | |
| Example | T1 | C8 | C7 | T1 | C8 | C7 | Av.-Grad. | Dmin. | Speed |
| 1 | — | — | — | — | 7.5 | — | 6.37 | 1.93 | 1.80 |
| 2 | — | 3.75 | — | — | — | 3.75 | 3.60 | 1.83 | 2.02 |
| 3 | — | 3.75 | — | — | — | 3.75* | 3.30 | 1.89 | 2.02 |
| 4 | 3.50 | — | — | 3.50[1] | — | — | 4.81 | 2.00 | 1.94 |
| 5 | 3.50 | — | — | 3.50[2] | — | — | 4.48 | 2.24 | 1.95 |
| 6 | 3.50 | — | — | — | 3.50[3] | — | 3.62 | 2.11 | 1.91 |
| 7 | 3.50 | — | — | — | — | 3.50 | 2.20 | 2.35 | 2.00 |

[1]12 g;
[2]18 g; and
[3]4 g/mole of $AgNO_3$ of dye according to the formula (I) given hereinbefore, wherein $R^1$ represents p-carboxyphenyl; $R^2$ represents $CH_3$ and $R^3$ represents H, with OH in para-position vs. the methine group.
*mixture of C7 emulsion with C5 emulsion in a weight ratio amount of 1:1.

Results

After drying and hardening, the materials were subjected to a simulation exposure during 30 s at both sides of the film materials through a continuous wedge having a constant of 0.15 by means of white light from a tungsten lamp after a Corning 5850 filter and carbon black grey filters having a density of 1.35 and 0.95, followed by processing. The developing step proceeded in developer G135 during 1 minute and 43 seconds at 28° C., wherein developer G135 and fixer G335 are both trademarked products from Afga-Gevaert NV used for the processing of non-destructive testing materials.

Further explanation for sensitometric data is given hereinafter:

(i) Av.Grad.: the average gradation at medium densities, defined as the slope of the line drawn by connecting the points at which the optical density is equal to Dmin+1.5 and Dmin+3.5; as described above, this parameter corresponds to the perceived diagnostic contrast as a higher value provides better diagnostic information;

(ii) Dmin: corrected for the density of the blue coloured polyester support;

(iii) Speed: measured at a density of Dmin+2.0 (a lower figure is representative for a higher speed)

TABLE 4

| | Emulsion coating weights ($g/m^2$ $AgNO_3$) | | | | | | |
|---|---|---|---|---|---|---|---|
| | Upper emulsion layer B | | Lower emulsion layer A | | Sensitometric results | | |
| Example | T1 | C8 | T1 | C8 | Av.-Grad. | Dmin. | Speed |
| 1 | 3.50 | — | — | 3.50 | 3.74 | 1.98 | 1.87 |
| 2 | — | — | 7.00 | — | 5.14 | 2.00 | 1.89 |

Results

After drying and hardening, the materials were subjected to exposure, followed by processing as described hereinbefore. As can be concluded from the sensitometric results obtained in the Tables 3 and 4, a good compromise is attained between a high sensitivity (speed) and a lower average gradient (contrast: preferably between about 3.50 and 4.00) when materials are built up from a layer arrangement according to the present invention: see e.g. Examples 4 and 6 in Table 3, illustrative for the role of the dye (compare e.g. with Example 5) and Examples 1 and 2 in Table 4.

For the inspection of thicker samples as e.g. concretes an X-ray source having an energy of up to 200 keV is not suitable as for such thick samples a lower energy is required. A higher exposure contrast is then obtained normally, unless a layer arrangement of the material as in the present invention is provided without loss in speed.

We claim:

1. A black-and-white silver halide photographic material comprising a support and on both sides thereof two light-sensitive emulsion layers and a protective antistress layer as an outermost layer, wherein per side of the support a total amount of silver, expressed as equivalent amount of silver nitrate of at least 5 g is coated, wherein the light-sensitive emulsion layer more close to the said outermost layer is provided with at least one silver halide emulsion having tabular emulsion crystals with {111} or {100} major faces, spectrally sensitized in the wavelength range comprised between 350 and 500 nm, and wherein the emulsion layer more close to the said support is provided with at least one non-spectrally sensitized emulsion having essentially cubic silver halide emulsion crystals, characterized in that the said cubic emulsion crystals or the said tabular emulsion crystals or both have a halide composition including bromide.

2. Material according to claim 1, wherein the said silver halide emulsion crystals including bromide have at least 75 mole % of bromide, based on silver.

3. Material according to claim 1, wherein said tabular emulsion crystals with {111} or {100} major faces and said cubic crystals are containing iodide in an amount of from 0.1 up to 3 mole %.

4. Material according to claim 1, wherein said tabular silver halide emulsion crystals have an average aspect ratio of at least 2:1, an average crystal thickness of less than 0.3 $\mu$m and account for at least 50% of the total projected area of all grains.

5. Material according to claim 1, wherein said tabular silver halide emulsion crystals have an average aspect ratio of at least 5:1, an average grain thickness of less than 0.25 $\mu$m and account for at least 70% of the total projected area of all grains.

6. Material according to claim 1, wherein the said essentially cubic emulsion crystals have an average crystal diameter of from 0.1 to 1.5 $\mu$m.

7. Material according to claim 1, wherein said material is a double-side coated industrial radiographic material, coated with a total amount of silver, expressed as an equivalent amount of silver nitrate, of from 5 $g/m^2$ up to 15 $g/m^2$.

8. Material according to claim 1, wherein the protective antistress layer and/or at least one of the two emulsion layers comprise(s) a disulfide compound.

9. Image forming system wherein the said material according to claim 1, in contact with intensifying screens at both sides of the film material, is subjected to the steps of exposing with an X-ray radiation source having an energy output of from 50 keV up to 5 MeV, processing comprising the steps of developing, fixing, rinsing and drying.

10. Image forming system according to claim 9, wherein in the said developing step the developer comprises a disulfide compound.

11. Image forming system according to claim 9, wherein in the said developing step the developer comprises 3,3' dithiobis(3,3'-diphenyl)-propionic acid as a disulfide compound.

* * * * *